US006074243A

United States Patent [19]

Edwards

[11] Patent Number: 6,074,243

[45] Date of Patent: Jun. 13, 2000

[54] ELECTRICAL CONNECTION APPARATUS

[76] Inventor: Jimmy Lee Edwards, P.O. Box 1599, Silver Springs, Fla. 34489-1599

[21] Appl. No.: 08/889,398

[22] Filed: Jul. 8, 1997

[51] Int. Cl.[7] ..... H01R 11/00

[52] U.S. Cl. ..... 439/504; 439/762

[58] Field of Search ..... 439/504, 761, 439/762; 411/409, 401, 402, 408, 379, 395, 369

[56] References Cited

U.S. PATENT DOCUMENTS 1,289,450 12/1918 Holaday ..... 411/408
1,713,735 5/1929 Benson ..... 439/762
1,949,618 3/1934 Mollberg ..... 29/157
4,639,654 1/1987 Braxton et al. ..... 320/2

*Primary Examiner*—Gary F. Paumen
*Assistant Examiner*—Alexander Gilman
*Attorney, Agent, or Firm*—Steven R. Scott

[57] ABSTRACT

An Electrical Connection Apparatus for automotive batteries having, in its preferred embodiments a multi-purpose screw threaded bolt with an enlarged head which can be inserted into the side terminal aperture of a battery to form a terminal post for connection of standard top post cable connector, may be provided with perforations allowing it to be tightened/loosened by any linear object, may be utilized as a tightening bolt for a C clamp type cable connector, and may be utilized in conjunction with branching cables for simultaneous connection to the top and side terminals of dual terminal automotive type batteries.

27 Claims, 3 Drawing Sheets

ELECTRICAL CONNECTION APPARATUS

BACKGROUND

1. Field of the Invention

This instant invention relates to the general field of cables and terminals for automotive type batteries. More specifically, it describes novel designs for cables, battery posts/terminals, and terminal connectors.

2. Prior Art in the Field

Present automotive batteries have terminals that serve as points of connection for electrical cables. These terminals may have side terminals, top terminals and, in an increasing number of cases, both. As is true with most electrical connectors, terminals may also be classified as male or female in configuration. Top terminals are generally "male" and are formed from immovable posts, whereas side terminals are generally "female" and are formed by an indention adapted to receive a bolt (typically a bolt ¼ inch in width and ⅜ inches in depth). Due to this difference, the nature of the connectors at the ends of electrical cables also vary depending on whether the cable is to be connected to a top post or to a side terminal. Connectors for a top post are generally formed from a "C" shaped "female" element that fits over the post and is tightened thereon by tightening down on a bolt that extends between (and connects) the two ends of the aforesaid element. Connectors for side terminals are usually formed from a simple perforated disk in combination with an appropriately sized bolt. The aforesaid bolt is placed through the perforation in the disk and screwed snugly into the side terminal, serving as the "male" element in the connective combination and creating an electrically conductive connection between the cable and the side terminal.

The aforesaid features lead to a basic matching problem: Cables with "female" connectors adapted for connection to a "male" top post cannot normally be used with a "female" side terminal battery and vice versa. The more recent introduction of a battery having both side terminals and top posts provides a partial solution for this problem; however, there is still need for simple means for connecting the more standard "female" cable connectors with "female" side terminals where necessary. Moreover, there is a continuing need for connectors and terminals that are easier to use, and for terminals that are easier to connect to "jumper" cables than those in current use.

SUMMARY AND OBJECTS OF THE INVENTION

The instant invention encompasses a revolutionary new design for cables, terminal connectors and side terminals for automotive batteries. As to cables, it involves the production of cables in which each cable (positive or negative) branches into two ends having two connectors. This allows simultaneous connection to both the top and the side pole having the same polarity on a battery having both top and side poles. As to terminal connectors, it encompasses a unitary design having a terminal/bolt element that can be used for (i) the easy tightening/loosening of a female connector element to/from a top/post terminal while serving simultaneously as an ideal jumper cable connection location, (ii) easy insertion into and/or removal from a side terminal aperture while serving simultaneously as an ideal jumper cable connection location, and (iii) when inserted in a side terminal aperture, creates a "male" post, allowing connection of standard top terminal post connectors to a side post battery. Moreover, the designs discussed herein are economical in construction, rugged and well adapted for ease of manufacture and use.

DETAILED DESCRIPTION OF THE PREFERRED EMBODIMENT

Figure 1:
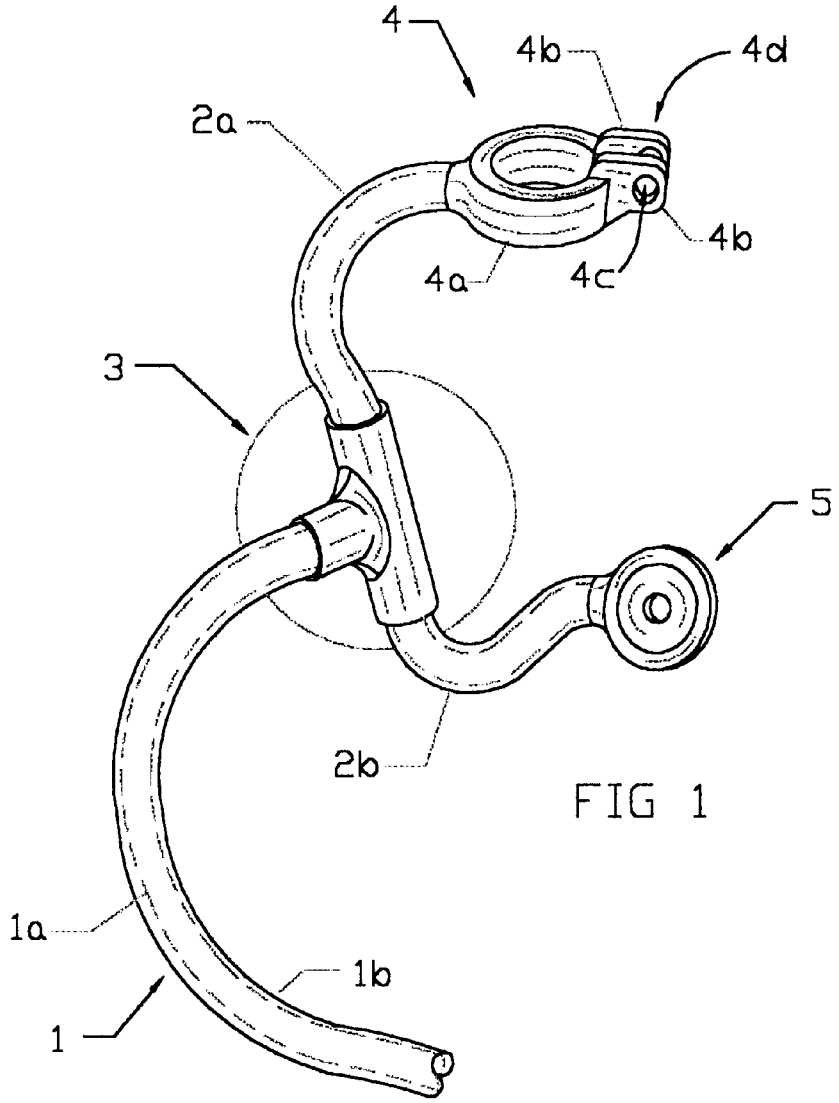
FIG. 1 illustrates a basic split cable design as taught by this invention.
Figure 2:
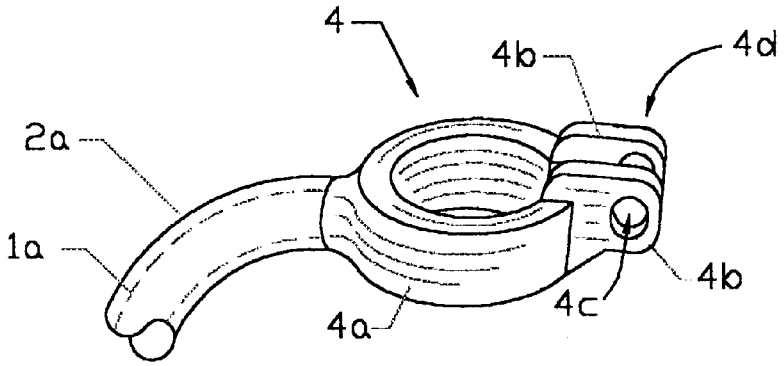
FIG. 2 provides a perspective view of the basic connector element clamp taught by this invention.

As illustrated in FIG. 1, the preferred embodiment of the cable utilized in the instant invention for use with batteries having both top and side terminals would be split so that both the positive cable (denoted generally by arrow 1) and the negative cable (not illustrated) branch into two terminal connector ends—first connector end 2*a* and second connector end 2*b*—for connection to, respectively, the top and side terminals of a battery. The branch location (indicated generally as that portion of the cable 1 in the circle denoted by arrow 3) may be in the form of a "Y" or a "T" or any other convenient configuration for this purpose. The branch location 3 may be advantageously formed utilizing a crimped multi-wire connection, a woven connection, or by other means well known in the art. As is typical in the art, the cable 1 is comprised of a conducting core la and an insulating sheath 1*b*

The first connector end 2*a* may be fitted with a standard top terminal connector fitting (as known in the art) and the second connector end 2*b* fitted with a standard side terminal connector 5. However, it is deemed more advantageous to fit at least the first connector end 2*a* for the top terminal (and preferably both first connector end 2*a* and second connector end 2*b*) with a connector element (denoted generally by arrow 4) adapted for use with the novel connector element bolt 6 taught in this invention. This connector element 4 may advantageously take the form of a "C" shaped clamp with a rounded portion 4*a* and extended tabs 4*b* having blank perforation 4*c* and threaded perforation 4*d*. The perforations 4*c* and 4*d* are adapted for insertion and screw tightening of the basic connector element bolt described below with reference to FIGS. 3 and 4. Thus, although both perforation 4*c* and 4*d* necessarily have a diameter of approximately ¼ inch, the connector element bolt is initially inserted through blank perforation 4*c*, and is next threaded through threaded perforation 4*d* (which is self tapped), allowing tightening of the connection. (Alternatively, a nut may be welded or otherwise affixed in place of threaded perforation 4*d*, allowing both perforations to be blank perforations). The extended tabs 4*b* should be of such length (and the perforations 4*c* and 4*d* spaced outwardly from the rounded portion 4*a* on said extended tabs 4*b* at such distance) as to allow the enlarged head section 6*b* of the basic connector element bolt 6*b* to snugly abut the extended tabs 4*b* when tightened. For the embodiment illustrated, perforations 4*c* and 4*d* would, therefore, need to be spaced outwardly from rounded portions 4*a* on extended tabs 4*b* approximately ½ and spaced upwardly from the base of the battery by approximately ½. Supporting braces (not shown) may also be added between curved portion 4*a* and extended tabs 4*b* to eliminate folding of the tabs 4*b* upon tightening.

Figure 3:
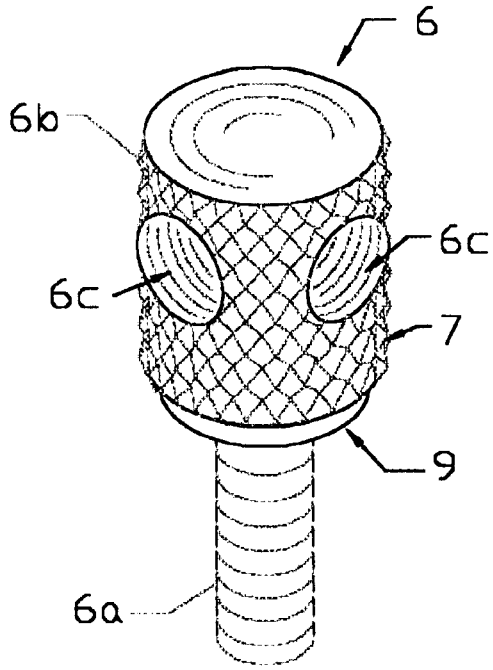
FIG. 3 provides a perspective view of the basic connector element bolt taught by this invention.
Figure 4:
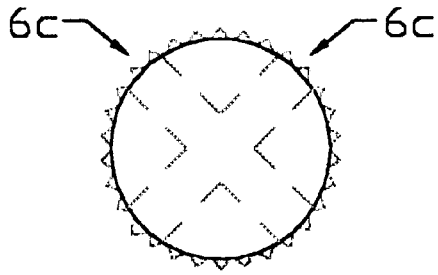
FIG. 4 provides a top view of the basic connector element bolt taught by this invention.
Figure 6:
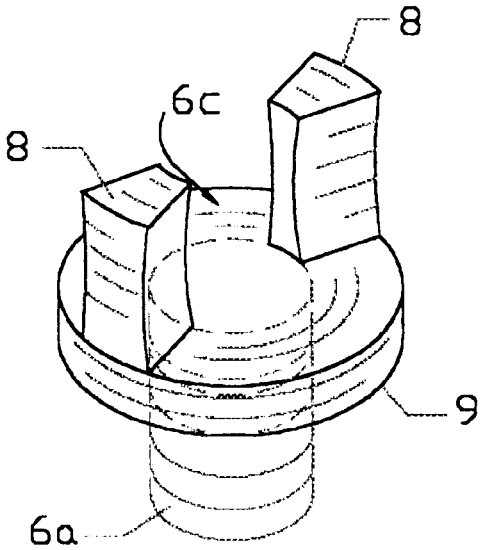
FIG. 6 provides a perspective view of an alternative design for a connector element bolt as taught by this invention.
Figure 5:
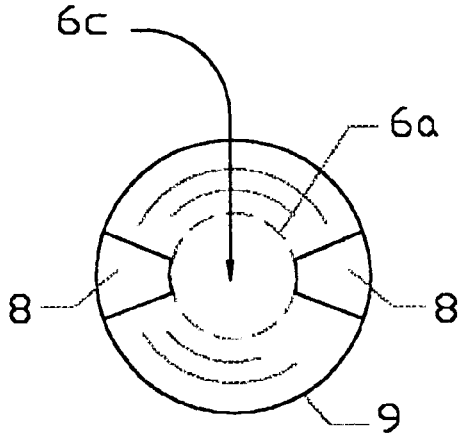
FIG. 5 provides a top view of an alternative design for a connector element bolt as taught by this invention.
Figure 7:
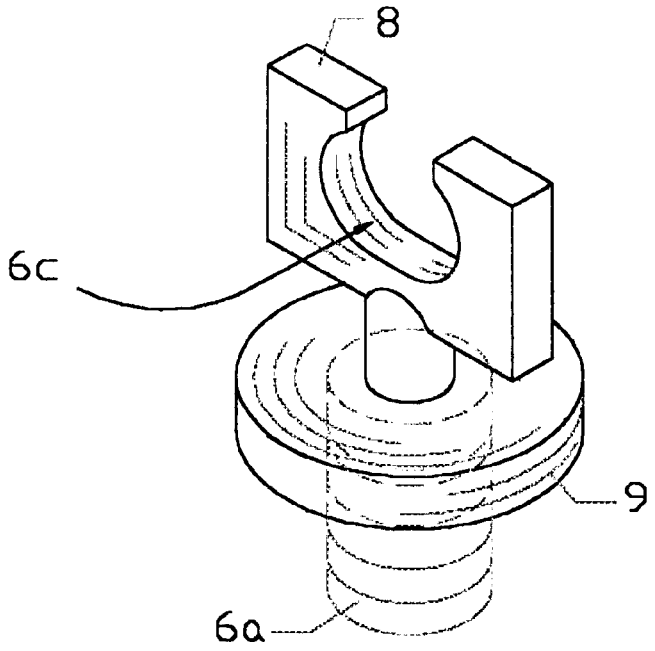
FIG. 7, provides a perspective view of a variation of the design for connector element bolt as taught by this invention.
Figure 8:
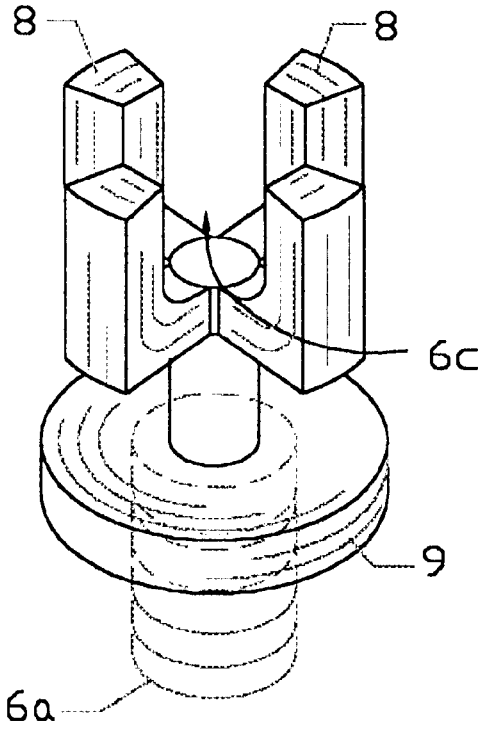
FIG. 8 provides a perspective view of another variation of the design for connector element bolt as taught by this invention.

As illustrated in FIGS. 3 and 4, the basic connector element bolt (denoted by arrow 6) taught by this invention has both (i) a standard screw threaded section 6*a* at least ⅜ inches in length and ¼ inches in width (which is adapted to fit into the side terminal of a battery), and (ii) an enlarged head section 6*b* approximately ¾ inches in diameter and ¾ inches in length (which gives it the approximate dimensions of a standard top post for a battery). The head section 6*b* may advantageously be formed in a standard cylindrical configuration with cylindrical perforations (denoted by arrows 6*c*) as illustrated in FIGS. 3 and 4. (This embodiment is preferred as it may be utilized to create an "top post" configuration by insertion into a side terminal aperture as well as being used for the other purposes discussed in this invention). Alternative "winged" configurations are illustrated in FIGS. 5, 6, 7 and 8. The winged configurations are provided with wings 8 and a base disk 9 as well as sharing numerous other features denominated and discussed with reference to the first embodiment described.

Both configurations should ideally be provided with grooves or some other form of texturing (denoted generally by arrow 7) on their outer surface to provide a stronger gripping surface for wrench or pliers and to form a superior conducting contact surface for jumper cable connectors. In both embodiments ease of tightening and loosening is facilitated by the inclusion of cylindrical perforations 6*c* which serve as means for insertion of a screw driver barrel or other cylindrical tool. (They may, therefore, be tightened and loosened without wrench or pliers, although these may also be used in the alternative if desired). This allows the user, who often has a limited number of tools available, especially in an emergency situation, to loosen or tighten connector element bolt 6 using a screw driver, a nail or almost any other linear tool that can serve as a lever arm and provide mechanical advantage to the user. This feature greatly facilitates the use and removal of the elements illustrated, eliminating many of the major inconveniences associated with current designs. The two embodiments for a connector element bolt 6 shown should, however, be considered as illustrative rather than exhaustive of design possibilities. Numerous shapes may be used for this purpose, including multi-winged designs.

As previously noted, the threaded section 6*a* of the connector element bolt 6 is adapted by its size to screw into the side terminal of a standard battery. Thus, connector element bolt 6 is designed to provide a substitute for the bolt typically utilized to fasten the standard side terminal connector 5 thereto, and to provide a shape and features that are (i) more easily tightened/loosened, and (ii) more adapted for connection of jumper cables. Likewise, when used in conjunction with the "C" shaped clamp 4 designed for attachment to the top terminal of a battery, they provide these same features in this role. Finally, when utilized with the preferred dual terminus cable design illustrated in FIG. 1, they constitute a complete and novel system for cables and terminals that offer numerous advantages over the designs in current use. However, as with all inventions, many variations are possible without exceeding the ambit of the inventive concept. Thus, the exact nature of the invention claimed is to be derived from the claims that follow:

I claim:

1. An electrical connection apparatus for automotive type batteries, comprising:

(a) an electrical cable having one end that branches to form two terminal connection ends;

(b) terminal connection means located at each of said two terminal connection ends; and (c) at least one bolt element having (i) a cylindrical screw threaded portion adapted for insertion into the side terminal of an automotive battery, the central axis of said cylindrical screw threaded portion defining a first axis, (ii) an expanded head portion provided with at least one perforation, and (iii) a generally planar member intermediate said cylindrical screw threaded portion and said expanded head portion and perpendicular to said first axis.

2. An electrical connection apparatus for automotive type batteries, as described in claim 1, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

3. An electrical connection apparatus for automotive type batteries, as described in claim 2, wherein said expanded head portion is comprised of at least one flat wing, said at least one flat wing lying in and defining a first plane, and the first axis lies in said first plane.

4. An electrical connection apparatus for automotive type batteries, as described in claim 3, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

5. An apparatus as described in claim 2 wherein the bolt element comprising a generally cylindrically shaped second axis being coaxial with the first axis, with a length, as measured along said second axis of approximately ¾ inches, and a width, as measured perpendicular to said second axis, of approximately ¾ inches.

6. An electrical connection apparatus for automotive type batteries, as described in claim 5, the generally cylindrical shape of said head portion defining two ends, the first end being that adjacent to said cylindrical screw threaded portion and the second end being that distant therefrom, the width of said head portion at the, first end being approximately 11/16 inches and the width of said head portion at the second end being approximately ⅝ inches.

7. An electrical connection apparatus for automotive type batteries, as described in claim 5, the generally cylindrical shape of said head portion defining two ends, the first end being that adjacent to said cylindrical screw threaded portion and the second end being that distant therefrom, the width of said head portion at the first end being approximately ¾ inches and the width of said head portion at the second end being approximately 11/16 inches.

8. An electrical connection apparatus for automotive type batteries, as described in claim 2, wherein said expanded head portion is cylindrically shaped, the central axis of said cylindrical shape defining a second axis, and said second axis is coaxial with the first axis.

9. An electrical connection apparatus for automotive type batteries, as described in claim 3, wherein at least one of the terminal connection means is comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforation, and so serve to draw said tabs together, tightening said C shaped clamp.

10. An electrical connection apparatus for automotive type batteries, as described in claim 3, wherein the length of said expanded head portion, as measured along said second axis, is approximately ¾ inches, and the width of said expanded head portion, as measured perpendicular to said second axis, is approximately ¾ inches.

11. An electrical connection apparatus for automotive type batteries, as described in claim 5, wherein at least one of the terminal connection means is comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforation, and so serve to draw said tabs, together, tightening said C shaped clamp.

12. An electrical connection apparatus for automotive type batteries, as described in claim 2, wherein at least one of the terminal connection means is comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforations, and so serve to draw said tabs together, tightening said C shaped clamp.

13. An electrical connection apparatus for automotive type batteries, as described in claim 6, wherein the portion of said C shaped clamp lying between said two ends lies generally in and defines a clamp plane, and wherein the tabs extending from said two ends do not lie generally in said clamp plane.

14. An electrical connection apparatus for automotive type batteries, as described in claim 6, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

15. An electrical connection apparatus for automotive type batteries, as described in claim 14, wherein the portion of said C shaped clamp lying between said two ends lies generally in and defines a clamp plane, and wherein the tabs extending from said two ends do not lie generally in said clamp plane.

16. An electrical connection apparatus for automotive type batteries, comprising a bolt element having (i) a cylindrical screw threaded portion adapted for insertion into the side terminal of an automotive battery, the central axis of said cylindrical screw threaded portion defining a first axis, (ii) an expanded head portion provided with at least one perforation, and (iii) a generally planar member intermediate said cylindrical screw threaded portion and said expanded head portion and perpendicular to said first axis.

17. An electrical connection apparatus for automotive type batteries, as described in claim 9, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

18. An electrical connection apparatus for automotive type batteries as described in claim 9, wherein said expanded head portion is comprised of at least one flat wing, said at least one flat wing lying in and defining a first plane, and the first axis lies in said first plane.

19. An electrical connection apparatus for automotive type batteries, as described in claim 11, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

20. An electrical connection apparatus for automotive type batteries, as described in claim 9, further comprising at least one terminal connection means, said terminal connection means being comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforation, and so serve to draw said tabs together, tightening said C shaped clamp.

21. An electrical connection apparatus for automotive type batteries, as described in claim 13, wherein the portion of said C shaped clamp lying between said two ends lies generally in and defines a clamp plane, and wherein the tabs extending from said two ends do not lie generally in said clamp plane.

22. An electrical connection apparatus for automotive type batteries, as described in claim 13, wherein the length of said cylindrical screw threaded portion, as measured along said first axis, is approximately ½ inches, and the diameter of said cylindrical screw threaded portion, as measured perpendicular to said first axis, is approximately ½ inches, and said at least one perforation is cylindrical.

23. An electrical connection apparatus for automotive type batteries, as described in claim 22, wherein the portion of said C shaped clamp lying between said two ends lies generally in and defines a clamp plane, and wherein the tabs extending from said two ends do not lie generally in said clamp plane.

24. An electrical connection apparatus for automotive type batteries, as described in claim 9, wherein said expanded head portion is cylindrically shaped, the central axis of said cylindrical shape defining a second axis, and said second axis is coaxial with the first axis.

25. An electrical connection apparatus for automotive type batteries, as described in claim 10, wherein at least one of the terminal connection means is comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforation, and so serve to draw said tabs together, tightening said C shaped clamp.

26. An electrical connection apparatus for automotive type batteries, as described in claim 10, wherein the length of said expanded head portion, as measured along said second axis, is approximately ¾ inches, and the width of said expanded head portion, as measured perpendicular to said second axis, is approximately ¾ inches.

27. An electrical connection apparatus for automotive type batteries, as described in claim 12, wherein at least one of the terminal connection means is comprised of a C shaped clamp, which shape defines two ends, each of said two ends having tabs extending therefrom, one of said tabs having a blank perforation and the other said tab having a screw threaded perforation adapted to receive the screw threaded portion such that the screw threaded portion can first be inserted through the blank perforation, then threaded through the screw threaded perforation, and so serve to draw said tabs together, tightening said C shaped clamp.

* * * * *